US006105289A

United States Patent [19]

Grandis

[11] Patent Number: 6,105,289

[45] Date of Patent: Aug. 22, 2000

[54] METHOD AND APPARATUS FOR EFFECTING THE SIMULATED INTERNAL LUMINESCENCE OF A TRANSLUCENT OBJECT

[75] Inventor: Devin Grandis, DelRay Beach, Fla.

[73] Assignee: Advanced Power Technologies, Inc., Pompano Beach, Fla.

[21] Appl. No.: 09/179,061

[22] Filed: Oct. 26, 1998

[51] Int. Cl.[7] ..... G09F 13/00

[52] U.S. Cl. ..... 40/444; 40/442; 40/547

[58] Field of Search ..... 40/547, 442, 443, 40/444, 446

[56] References Cited

U.S. PATENT DOCUMENTS

| | | | |
|---|---|---|---|
| 3,184,872 | 5/1965 | Way | 40/547 |
| 4,807,095 | 2/1989 | Bell | 362/127 |
| 5,497,706 | 3/1996 | Yong | 108/23 |

*Primary Examiner*—Cassandra H. Davis
*Attorney, Agent, or Firm*—James H. Beusse; Holland & Knight LLP

[57] ABSTRACT

A display system for translucent objects comprising a shelf having an upper surface and a lower surface with apertures extending through the shelf. A fiber optic strand has an input end and an output end positioned through each aperture with its output end located at the upper surface of a shelf and with the strands extending downwardly to the bottom end and rearwardly thereof and terminating at a remote location. A source of illumination is located adjacent to the input end with a color wheel is rotatable in a path of travel between the source of illumination and the input ends of the bundle, the color wheel including segments of different colors whereby rotation of the color wheel while the source of illumination is illuminated will effect a continuous change of colors at the output end for providing a simulated internal luminescence of the objects being displayed. A supplemental shelf is located above the shelf with a lower surface. An accent strip is located across the width of the lower surface of a supplemental shelf with supplemental apertures therethrough and fiber optic strands extending through the apertures of the accent strip essentially overlying the output end of the aperture of the shelf for supplemental illumination of the objects.

5 Claims, 3 Drawing Sheets

METHOD AND APPARATUS FOR EFFECTING THE SIMULATED INTERNAL LUMINESCENCE OF A TRANSLUCENT OBJECT

BACKGROUND OF THE INVENTION

The present invention relates to a display system and, more particularly, pertains to a method and apparatus for effecting a simulated internal luminescence of a translucent object.

DESCRIPTION OF THE BACKGROUND ART

Display systems of various designs and configurations are known in the prior art. A typical display system utilizes either a focus or diffused light to illuminate an object for viewing. For example, many display cabinets include fluorescent lighting to illuminate objects in the cabinets. Museums and art studios commonly use individual focused lighting for separate pieces of art. All of the prior art systems are believed to use lighting which is directed onto an object and illuminates the object by reflection.

SUMMARY OF THE INVENTION

The present invention provides an improved method and apparatus for illuminating certain objects on display and, more particularly, for creating a changing luminescent illumination effect on display objects which have translucent characteristics. In an illustrative embodiment, the inventive illumination system is used in conjunction with a multi-level shelf display of bottled beverages such that the individual bottles appear to glow or luminesce from within. Each beverage may have a different composition and produce a unique luminescence in response to changing illumination, such as, for example, by changing of the color of the illuminating light.

To attain this, the present invention essentially comprises a display system for the simulated internal luminescence of translucent objects being displayed comprising a plurality of supporting shelves. Each shelf has an upper surface and a lower surface. Each shelf is of a different size so that they may be placed one upon the other in a staggered configuration for providing upper surfaces on each shelf for the receipt of translucent objects to be illuminated. A plurality of apertures extend through each shelf from the upper surface to the lower surface in a portion of the shelf to receive the objects to be displayed. A plurality of fiber optic strands is provided each having an output end and an input end. Each strand is positioned through an associated aperture with its output end located at the upper surface of a shelf and with the strands extending downwardly to the lower shelf and rearwardly thereof and terminating at a remote location. Coupling members secure the individual strands to a lower surface of an associated shelf.

Joining members secure together the strands into a bundle, with the bundle terminating at the remote location. A source of illumination is located adjacent to the input end. A color wheel is rotatable in a path of travel between the source of illumination and the input ends of the bundle. The color wheel includes segments of different colors whereby rotation of the color wheel while the source of illumination is illuminated will effect a continuous change of colors at the output end for providing a simulated internal luminescence of the objects being displayed on the strands. A supplemental shelf is located above the plurality of shelves with a lower surface. A plurality of sample accent strips are attached across the width of the lower surface of the supplemental shelf with supplemental apertures therethrough. A plurality of fiber optic strands extend through the apertures of the accent strips essentially overlying the output ends of the strands of the plurality of shelves for supplemental illumination of the objects. The supplemental strands include joining members to secure the strands together the supplemental strands into a bundle at the remote location for receiving light from the illumination source through the color wheel for varying the colors thereof. The profiles of the strips include V-shaped profiles with a forwardly extending horizontal portion for coupling the accent strip to the lower surface of the supplemental shelf and with at least one profile having a vertical strip for coupling the accent strip to a vertical edge of the supplemental shelf. The invention also includes the method of providing such system as described above and illuminating the translucent objects from above while rotating the color wheel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one primary embodiment and one alternate embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for effecting the simulated internal luminescence of a translucent object and associated method which has all the advantages of the prior art illumination systems of various designs and configurations and none of the disadvantages.

It is another object of the present invention to enhance the appearance of being displayed through a system which may be readily manufactured and deployed.

It is a further object of the present invention to continually change the color appearance of translucent objects being displayed for increasing viewer interest.

An even further object of the present invention is to cause the simulated internal luminescence of a translucent object and associated method which is susceptible of a low cost of manufacture with regard to both materials and labor, thereby making such system for effecting the simulated internal luminescence of a translucent object economically available to the public.

Still another object of the present invention is to provide a method and apparatus for enhancing the appeal of displayed objects by effecting a simulated internal luminescence of the objects.

Lastly, it is an object of the present invention to provide a display system for objects comprising a shelf having an upper surface and a lower surface. Also provided is an aperture extending through the shelf from the upper surface to the lower surface. A fiber optic strand have an output end and the input end is positioned through an aperture with its output end located at the upper surface of a shelf and with the strand extending downwardly to the bottom end and rearwardly thereof and terminating at a remote location. A source of illumination is located adjacent to the input end. A color wheel is rotatable in a path of travel between the source of illumination and the input end of the strand, the color wheel including segments of different colors whereby rotation of the color wheel while the source of illumination is illuminated will effect a continuous change of colors at the output end for providing illumination to the object being displayed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred and alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
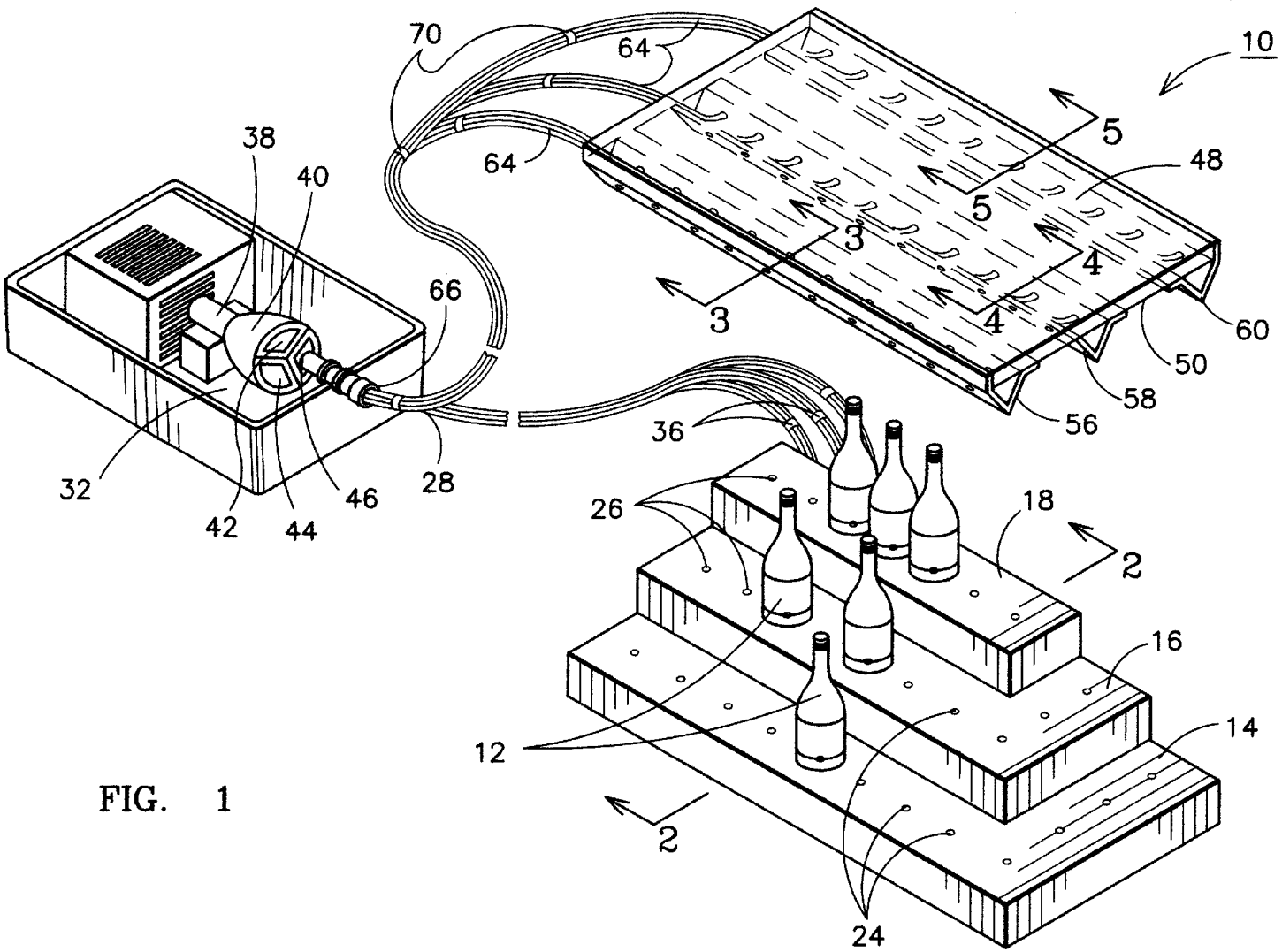
FIG. 1 is a perspective illustration of the preferred embodiment of the system for effecting the simulated internal luminescence of a translucent object and associated method constructed in accordance with the principles of the present invention.

With reference now to the drawings, and in particular to FIG. 1 thereof, a new and improved system for effecting the simulated internal luminescence of a translucent object and associated method embodying the principles and concepts of the present invention and generally designated by the reference numeral 10 will be described.

The present invention, the method and apparatus for effecting the simulated internal luminescence of objects, preferably translucent objects, is comprised of a plurality of components. Such components are individually configured and correlated with respect to each other so as to attain the desired objective.

More specifically, it will be noted that the display system 10 for the simulated internal luminescence of translucent objects 12 being displayed comprises, in combination, a plurality of supporting shelves 14, 16, 18. Note, in particular, FIG. 1. Each shelf has an upper surface 20 and a lower surface 22. Each shelf is of a different size so that they may be placed one upon the other in a staggered configuration. Such an arrangement thus provides for an upper surface 20 on each shelf being oriented for the receipt of translucent objects to be illuminated. In the preferred embodiment, shelves are intended to be located at a bar and the objects to be illuminated are transparent or translucent bottles of liquor, wine, cordials, etc., liquids of varying colors in bottles which may also be of varying colors.

Figure 2:
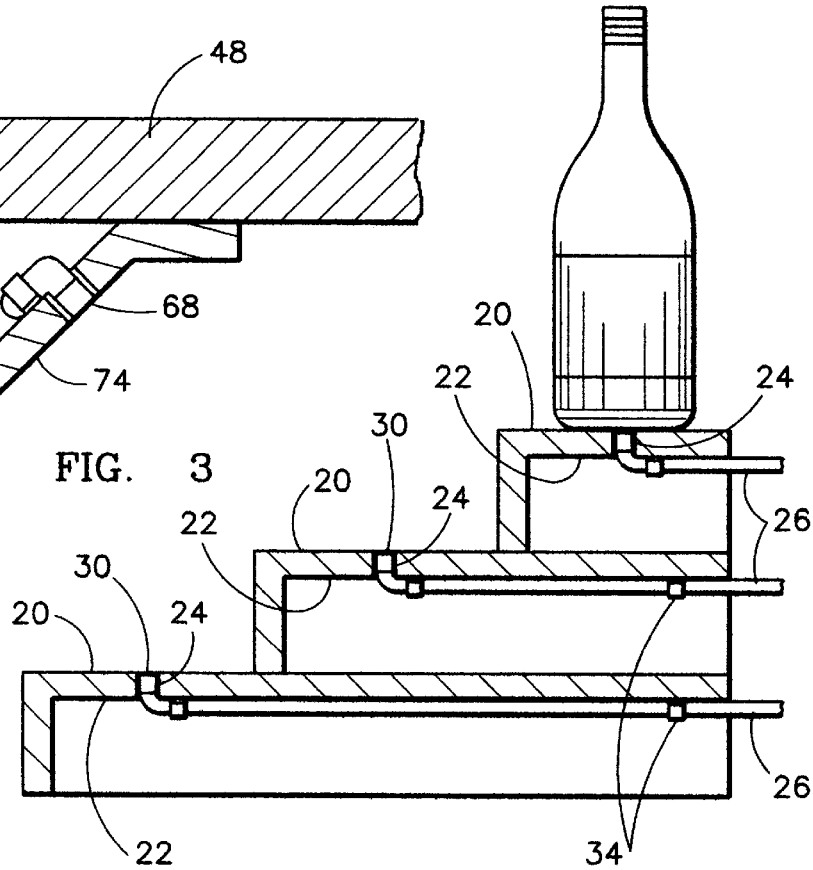
FIG. 2 is a cross-sectional view taken along line 2—2 of FIG. 1.

As can be understood from reference to FIG. 2, a plurality of axially aligned apertures 24 extend through each shelf. Such apertures extend from the lower surface to the upper surface of each shelf. The apertures are located at the display regions of the shelf which are to receive and support the bottles to be illuminated and displayed.

A plurality of fiber optic strands or fibers 26 are next provided. Each such strand has an input end 28 and an output end 30. Each strand is positioned by being press fit through an associated aperture with its output end located at a display region on the upper surface of a shelf. This can readily be seen with reference to FIG. 2. Each strand then extends downwardly to and through the lower surface. Each strand then extends rearwardly thereof and then terminates at a remote location 32.

Coupling members 34, preferably in the form of an adhesive tape, are then utilized to attach the individual strands to the lower surface of the associated shelf in which they are positioned.

Joining members 36, again preferably in the form of an adhesive tape, are then utilized to secure together the strands of each shelf into a bundle. The bundle for each shelf then terminates at the remote location 32 whereat the input ends of the bundled strands are all located.

Next provided is a source of illumination 38. Such source of illumination is positioned at the remote location in operative association adjacent to the input ends of the strands. The source of illumination functions for the illumination of the strands and the resultant illumination of objects on the shelves.

A color wheel 40, rotatable in a circular and continuous path of travel, is positioned between the source of illumination and the input ends of the bundles. The color wheel preferably includes segments of different colors 42, 44, 46. In this manner, rotation of the color wheel, while the source of illumination is illuminated, will effect a continuous change of colors at the input ends and, hence, the output ends of the strands. This arrangement is for providing a simulated and changing internal luminescence of the objects when positioned over the strands for being displayed. Although only three colors are disclosed, it should be appreciated that any number of colors may be utilized in the color wheel. An exemplary fiber optic illumination system which may be used to provide the varying color illumination is disclosed in U.S. Pat. No. 5,528,714, the subject matter of which is incorporated herein by reference.

A supplemental shelf 48 is next provided. Note FIGS. 1, 3, 4 and 5. Such supplemental shelf is located above the plurality of shelves 14, 16, 18. The supplemental shelf has a lower surface 50, a front edge 52 and a rear edge 54. Such supplemental shelf is optional and, in fact, could be dispensed with or could be any lower surface for supporting one or more accent strips as will be hereinafter described.

In operative association with the supplemental shelf 48 are a plurality of accent strips 56 forwardly, 58 intermediately and 60 rearwardly. Such accent strips are attached across the width of the lower surface of the supplemental shelf above the rows of bottles being displayed and to be illuminated. Such accent strips are formed with supplemental apertures 62 in parallel alignment through each strip.

Extending through each aperture of the accent strips is a supplemental fiber optic strand 64. Each supplemental strand is formed with an input end 66 and an output end 68. The output ends are positioned at locations essentially overlying the objects to be illuminated on the plurality of shelves. The accent strips and the output ends of the supplemental strands function for the supplemental illumination of the objects thereabove.

Joining straps 70, preferably in the form of an adhesive tape, are next employed for securing together into a bundle the strands for each strip. Such joining straps 70 are also for allowing the consolidated positioning of the input ends of the supplemental strands at the remote location. This allows for the input ends of the strands receiving light from the illumination source through the color wheel concurrently with the input ends of the strands 26. This concurrent illumination of all the strands allows for varying the color output of the accent strips as well as the shelves for a full varying the color of the objects being displayed from above and below.

Figure 3:
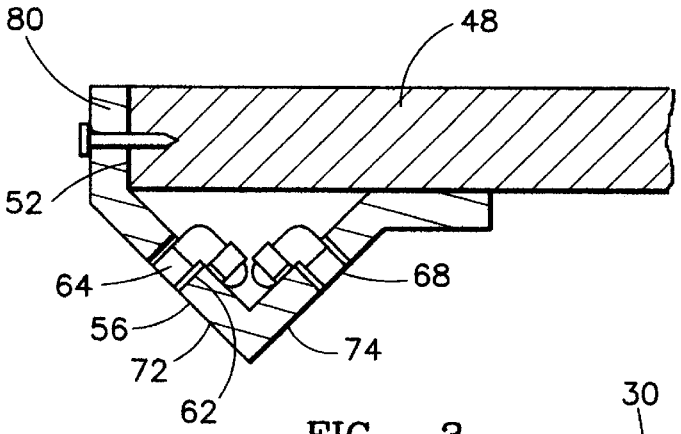
FIGS. 3, 4 and 5 are cross-sectional views taken at lines 3—3, 4—4 and 5—5 of FIG. 1, respectively.
Figure 4:
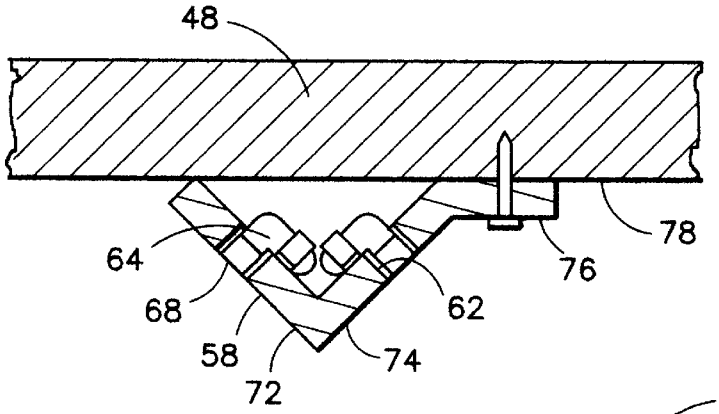
Figure 5:
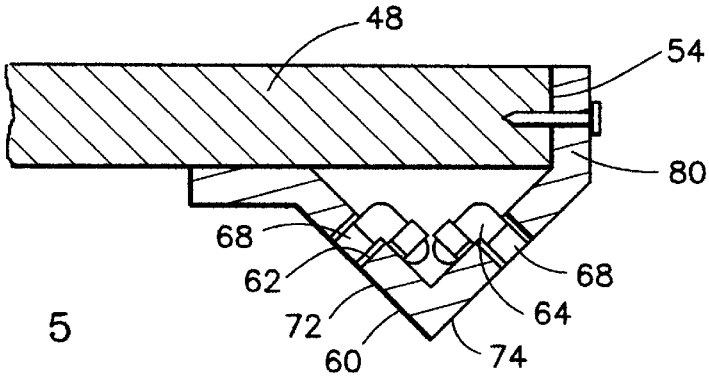

The profiles of the strips as shown in FIGS. 3, 4, and 5 include V-shaped profiles 72, 74. The intermediate accent strip 58 includes a rearwardly extending horizontal portion 76. The horizontal portion is for attaching the accent strip to the lower surface 78 of the supplemental shelf. Note FIG. 4. At least one profile preferably has a vertical leg 80. Such vertical leg is for coupling the rearward accent strip 60 to the rear vertical edge 54 of the supplemental shelf. Note FIG. 5. At least one profile preferably has a vertical portion for coupling the accent strip 56 to the front vertical edge 52 of the supplemental shelf. Note FIG. 3. Nails or other appropriate attachment mechanisms may be utilized for coupling the accent strips to the supplemental shelf.

Figure 6:
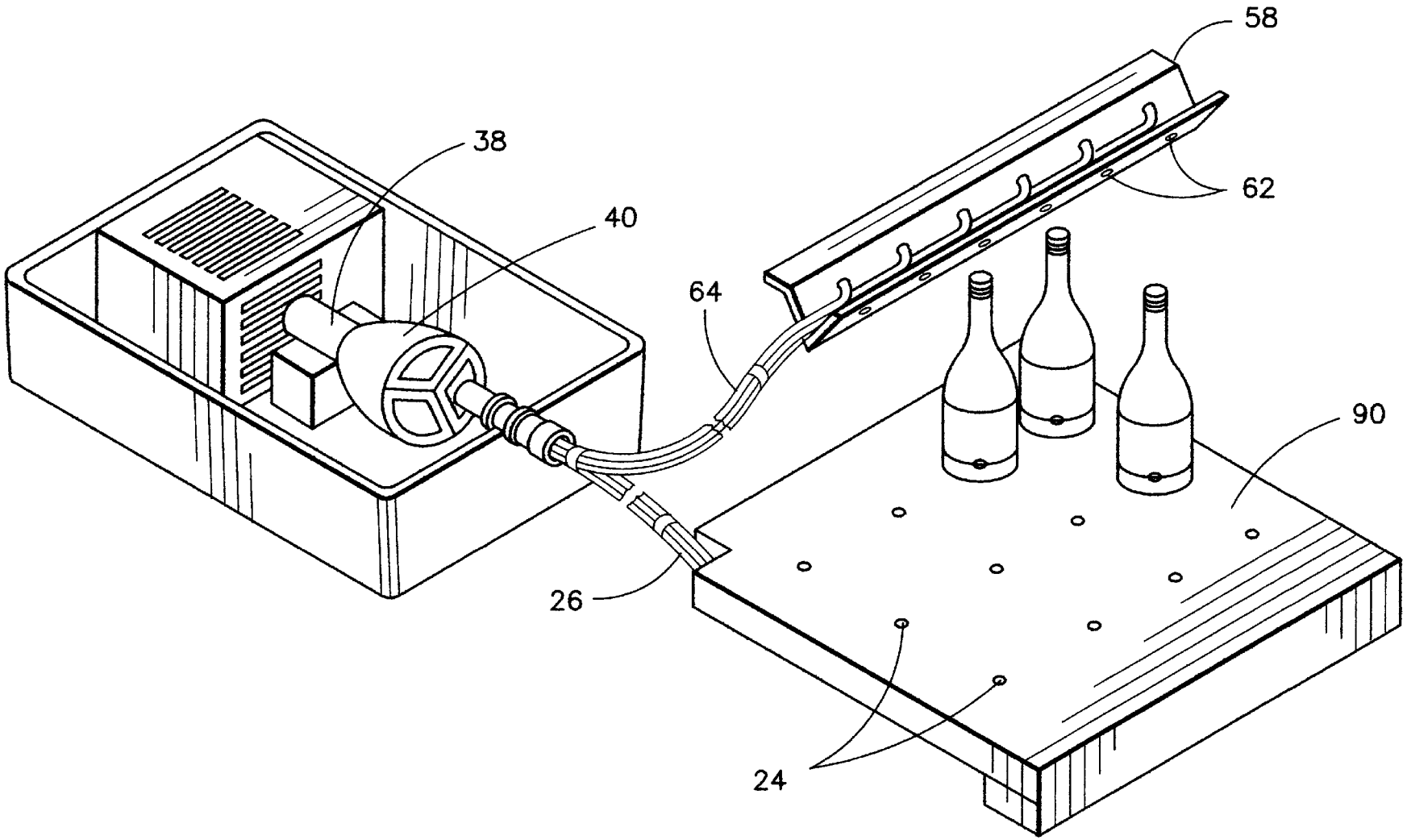
FIG. 6 is a perspective illustration of a system constructed in accordance with an alternate embodiment of the invention.

An alternate embodiment of the invention is illustrated in FIG. 6. In such embodiment, a single supporting shelf 90 is formed with plural rows and columns of apertures 24 with fiber optic strands 26 as in the primary embodiment. A single accent strip 58 with apertures 62 and fiber optic strands 64 is employed for supplemental illumination with a source of illumination 38 and color wheel 40 as in the primary embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A display system for the simulated internal luminescence of translucent objects being displayed comprising, in combination:

a plurality of supporting shelves, each shelf having an upper surface and a lower surface, each shelf being of a different size so that they may be placed one upon the other in a staggered orientation for providing upper surfaces on each shelf for the receipt of translucent objects to be illuminated;

a plurality of apertures extending through each shelf from the lower surface to the upper surface at display regions of the shelf to receive and support the objects to be displayed;

a plurality of fiber optic strands each having an input end and an output end, each strand being positioned through an associated one of the plurality of apertures with its output end located at the display region on the upper surface of a respective one of each shelf and with each strand extending downwardly through the lower surface and rearwardly thereof and terminating at a remote location;

coupling members to attach each of the fiber optic strands to the lower surface of the associated shelf in which the strands are positioned;

joining members to secure together the strands of each shelf into a bundle, with the bundle for each shelf terminating at the remote location;

a source of illumination at the remote location located adjacent to the input ends of the strands;

a color wheel rotatable in a path of travel between the source of illumination and the input ends of the bundles, the color wheel including segments of different colors whereby rotation of the color wheel, while the source of illumination is illuminated, will effect a continuous change of colors at the output ends of the strands for providing a simulated and changing internal luminescence of the objects being displayed;

a supplemental shelf above the plurality of shelves with a lower surface, a rear edge and a front edge;

a plurality of accent strips attached across the width of the lower surface of the supplemental shelf with supplemental apertures through each strip;

a plurality of supplemental fiber optic strands with input ends and output ends extending through the apertures of the accent strips at locations essentially overlying the objects to be illuminated on the plurality of shelves for the supplemental illumination of the objects;

supplemental joining members for securing together the strands for each strip and for positioning the input ends of the supplemental strands at the remote location for receiving light from the illumination source through the color wheel for varying the color at the output ends thereof; and the accent strips including V-shaped profiles with a forwardly extending horizontal portion for attaching each accent strip to the lower surface of the supplemental shelf and with at least one profile having a vertical leg for coupling the accent strip to the rear edge of the supplemental shelf.

2. A display system for an object comprising:

a first shelf having an upper surface and a lower surface;

an aperture extending through the shelf from the upper surface to the lower surface;

a fiber optic strand having an output end and an input end, the output end being positioned through the aperture and located at the upper surface of the shelf and with the strand extending downwardly to the lower surface and rearwardly thereof and terminating at a remote location;

a source of illumination located adjacent to the input end of the strand;

a color wheel rotatable in a path of travel between the source of illumination and the input end of the strand, the color wheel including segments of different colors whereby rotation of the color wheel while the source of illumination is illuminated will effect a repetitive change of colors at the output end; and a supplemental shelf above the first shelf and an accent strip secured across a width of a lower surface of the supplemental shelf, with a supplemental aperture through the accent strip and another fiber optic strand extending through the supplemental aperture of the accent strip essentially overlying the aperture of the first shelf for supplemental illumination of an object positioned on the first shelf.

3. The system as set forth in claim 2 and further including a plurality of additional axially aligned apertures through the first shelf with a separate fiber optic strand extending through each additional aperture for illuminating a plurality of objects positioned on the shelf.

4. A display system for an object comprising:

a shelf having an upper surface and a lower surface;

an aperture extending through the shelf from the upper surface to the lower surface;

a fiber optic strand having an output end and an input end positioned through the aperture with its output end located at the upper surface of the shelf and with the strand extending downwardly to the lower surface and rearwardly thereof and terminating at a remote location;

a source of illumination located adjacent to the input end of the strand; and a plurality of axially aligned apertures through the shelf with another fiber optic strand extending through each aligned aperture for illuminating a plurality of objects and further including a supplemental surface above the shelf with an accent strip secured across a width of the supplemental surface and with a plurality of aligned supplemental apertures through the accent strip and a supplemental fiber optic strand extending through each aperture of the accent strip essentially overlying the apertures of the shelf for the supplemental illumination of the objects.

5. A method for effecting a simulated internal luminescence of a translucent object in a display comprising the steps of:

establishing a display surface for supporting a translucent object;

forming at least one passageway through the display surface directly below the object;

inserting at least one optical fiber into the passageway from below the display surface, the fiber having a first end positioned within the passageway and a second end positioned remotely; and directing light into the second end of the optical fiber whereby the light is directed through the fiber and exits from the first end into the object positioned on the display surface over the one passageway.

* * * * *